US006736902B2

(12) United States Patent
Tefft et al.

(10) Patent No.: US 6,736,902 B2
(45) Date of Patent: May 18, 2004

(54) HIGH-TEMPERATURE POWDER DEPOSITION APPARATUS AND METHOD UTILIZING FEEDBACK CONTROL

(75) Inventors: Stephen Wayne Tefft, Cincinnati, OH (US); Paul Charles Madix, Loveland, OH (US); James Robert Reinhardt, Okeana, OH (US); Tag Allen Koenig, Mentor, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/177,282

(22) Filed: Jun. 20, 2002

(65) Prior Publication Data

US 2003/0233979 A1 Dec. 25, 2003

(51) Int. Cl.[7] ..... B05C 11/00

(52) U.S. Cl. ..... 118/679; 118/676; 118/688; 118/308; 239/79; 239/85

(58) Field of Search ..... 118/308, 309, 118/663, 679, 712, 682, 683, 684, 688; 239/8, 79, 85, 13, 722, 690, 708, 104, 223–224, DIG. 15; 427/180, 446, 455, 456

(56) References Cited

U.S. PATENT DOCUMENTS

| | | | | |
|---|---|---|---|---|
| 2,714,563 A | | 8/1955 | Poorman et al. | |
| 4,613,259 A | | 9/1986 | Packer et al. | |
| 5,330,798 A | * | 7/1994 | Browning | 239/79 |
| 5,542,606 A | * | 8/1996 | Kadyrov et al. | 239/81 |
| 5,731,030 A | | 3/1998 | Friese et al. | |
| 5,958,522 A | * | 9/1999 | Nakagawa et al. | 427/456 |
| 6,083,330 A | | 7/2000 | Moskowitz | |
| 6,390,383 B1 | * | 5/2002 | Fusaro, Jr. et al. | 239/79 |

FOREIGN PATENT DOCUMENTS

| | | |
|---|---|---|
| DE | 19 44 428 | 3/1971 |
| EP | 0 361 710 A1 | 4/1990 |

OTHER PUBLICATIONS

Hoehle, H.M.; "Stand des Thermischen Spritzens"; Schweissen und Schneiden, Deutscher Verlag fur Schweisstechnek; Feb. 1, 1993; vol. 45, No. 2; Dusseldorf, DE.

* cited by examiner

*Primary Examiner*—Richard Crispino
*Assistant Examiner*—Y. T. Tadesse
(74) *Attorney, Agent, or Firm*—Gregory O. Garmong; Carmen Santa Maria; McNees Wallae & Nurick LLC

(57) ABSTRACT

A deposit is formed on a deposition substrate using a deposition gun that bums a mixture of a fuel and an oxidizer to form a deposition gas flow, mixes a powder into the deposition gas flow to form a deposition mixture flow, and projects the deposition mixture flow therefrom. The deposition gun is provided with a flowing coolant. A flow rate of the fuel to the deposition gun, a flow rate of the oxidizer to the deposition gun, a flow rate of the powder to the deposition gun, and a cooling capacity of the coolant flow are all measured. The flow rate of the fuel, the flow rate of the oxidizer, the flow rate of the powder, and the cooling capacity of the coolant flow are all controlled responsive to the step of measurements.

14 Claims, 2 Drawing Sheets

HIGH-TEMPERATURE POWDER DEPOSITION APPARATUS AND METHOD UTILIZING FEEDBACK CONTROL

This invention relates to the high-temperature deposition of a powder onto a substrate and more particularly, to the control of the powder deposition to achieve a high-quality, dense deposit over an extended period of deposition.

BACKGROUND OF THE INVENTION

The surfaces of articles are often subjected to extreme environmental conditions of temperature, corrosion, oxidation, wear, and the like. The base metal of the article is typically selected with mechanical properties such as strength, creep resistance, fatigue resistance, and the like in mind, and in many cases the base metal cannot withstand the surface environmental conditions. It is therefore common practice to protect the surfaces of the articles with a protective deposit or coating. The nature of the deposit is selected with consideration of the type of environmental conditions to which the article will be subjected in service.

In another application, an article may be made of a light-weight material that has adequate mechanical properties over most of its area, but inadequate mechanical properties in specific areas. Deposits may be applied in these areas to improve strength, fatigue resistance, creep resistance, and the like. In an example, a tungsten carbide/cobalt (WC/Co) hard-facing deposits are applied as stiffeners to titanium-alloy fan blades used in aircraft gas turbine engines.

There are many approaches to the deposition of relatively thin deposits on a substrate. The selection of an approach is made according to the nature of the material to be deposited, the nature of the substrate, the extent of the area to be coated, the required properties, the cost, and other considerations. In one popular deposition technology, a deposition apparatus generates a high temperature that at least partially melts the particles of a powder that is fed into the deposition apparatus. The mixture of hot gas and particles is projected out of the deposition apparatus and onto the surface of the article to be coated, where the melted portion solidifies to form an adherent coating.

When the coating must be of particularly high quality, the leading choice for such deposition is the detonation gun, or D-gun. In this device, a controlled explosion within the detonation gun produces a shock wave that partially melts the powder feed and propels it toward the substrate. The detonation gun has the disadvantage that it is large and heavy, and therefore must remain essentially fixed in location. The article to be coated must be moved to the proper position relative to the detonation gun. This requirement is troublesome when the article to be coated is large and itself difficult to manipulate. Additionally, it is desirable to improve upon the quality of the deposit over what may be accomplished with the detonation gun.

There is therefore a need for an improved high-temperature deposition approach. The present invention fulfills this need, and further provides related advantages.

SUMMARY OF THE INVENTION

The present invention provides a powder deposition apparatus and method that is highly controllable, is stable over extended periods, and uses a light-weight deposition gun that may be readily moved around an article being coated and is therefore amenable to robotic mounting and control. In studies leading to the present invention, it was determined that high-velocity oxyfuel (HVOF) powder deposition had the potential for a light-weight deposition gun and also the potential for producing high-quality deposits. The available HVOF deposition apparatus lacked sufficient controllability, leading to unacceptable quality of the deposits. The present invention provides for that controllability.

A powder deposition apparatus is operable to form a deposit on a deposition substrate. The powder deposition apparatus comprises a deposition gun having a combustion chamber wherein a mixture of a fuel and an oxidizer is burned to generate a pressurized deposition gas flow, a mixer wherein the pressurized deposition gas flow is mixed with a powder flow to form a deposition mixture flow, a deposition flow director that receives the deposition mixture flow from the mixer and directs the deposition mixture flow toward the deposition substrate, and a cooling structure operable with a flowing coolant (typically water) passing therethrough and in cooling communication with the mixer and with the deposition flow director. Using suitable sensors, an instrumentation array provides a fuel measurement of a flow rate of the fuel to the combustion chamber, an oxidizer measurement of a flow rate of the oxidizer to the combustion chamber, a powder measurement of a flow rate of a powder feed to the mixer, and a coolant measurement of a cooling capacity of the coolant. A deposition controller includes a controllable fuel source of the fuel communicating with the combustion chamber, wherein the controllable fuel source is automatically controlled responsive to the fuel measurement, and a controllable oxidizer source of the oxidizer communicating with the combustion chamber, wherein the controllable oxidizer source is automatically controlled responsive to the oxidizer measurement. A controllable powder source of the powder flow communicates with the mixer. The controllable powder source is automatically controlled responsive to the powder measurement. The deposition controller further includes a controllable coolant source of a flow of the coolant that provides an inlet flow of coolant to the cooling structure, wherein the controllable coolant source is automatically controlled responsive to the coolant measurement.

In one embodiment, the mixer comprises a central powder flow injector, and a set of deposition gas injectors arranged around a periphery of the central powder flow injector. The deposition flow director includes a barrel that receives the deposition mixture flow from the mixer, wherein the mixer is positioned at a first end of the barrel, and a powder spray nozzle positioned at a second end of the barrel opposite from the first end, wherein the powder spray nozzle is operable to project the deposition flow mixture toward the substrate. The cooling structure comprises a cooling jacket extending around at least a portion of the mixer and the deposition flow director.

Preferably, the controllable fuel source comprises a source of hydrogen gas, and the controllable oxidizer source comprises a source of oxygen gas. Most preferably, a flow ratio of the hydrogen gas to the oxygen gas is from about 2.2 to about 2.6. The controllable powder source comprises a source of a mixture of the powder entrained in a carrier gas. A most preferred powder is a mixture of tungsten carbide and cobalt powders.

In one version, the coolant measurement is a measured temperature of the flowing coolant, such as the measured temperature of the outlet flow of the coolant from the cooling structure. The deposition controller includes a heat exchanger that receives an outlet flow of the coolant, controllably cools the outlet flow of the coolant responsive to the measured temperature, and provides a cooled coolant flow to the cooling structure. The coolant measurement may instead be a measured flow rate of the coolant, and a flow controller provides the flow of the coolant responsive to the measured flow rate of the coolant.

Because of its small size and light weight, the deposition gun may be supported on and moved by a robotic head.

A method for forming a deposit on a deposition substrate comprises the steps of providing a deposition gun that burns a mixture of a fuel and an oxidizer to form a deposition gas flow, mixes a powder into the deposition gas flow to form a deposition mixture flow, and projects the deposition mixture flow therefrom. The deposition gun is provided with a flowing coolant. A flow rate of the fuel to the deposition gun, a flow rate of the oxidizer to the deposition gun, a flow rate of the powder to the deposition gun, and a cooling capacity of the coolant flow are all measured. The method includes set-point controlling the flow rate of the fuel, the flow rate of the oxidizer, the flow rate of the powder, and the cooling capacity of the coolant flow, all responsive to the step of measuring. Other compatible features of the invention as described herein may be used in conjunction with the method.

The present approach provides a deposition technology whose deposits are comparable in quality with, and sometimes superior to those of, detonation-gun technology. The present approach uses a light-weight deposition gun that is far more movable than the detonation gun, and accordingly allows the deposition gun to be moved rather than the article. Existing deposition technology was found to have the drawback, however, that it was closely dependent upon operating parameters such as fuel, oxidizer, and powder flow, and the cooling capacity of the coolant. The feedback control technique of the present invention increases the time stability of the deposition technique by controlling these parameters to set-point values.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
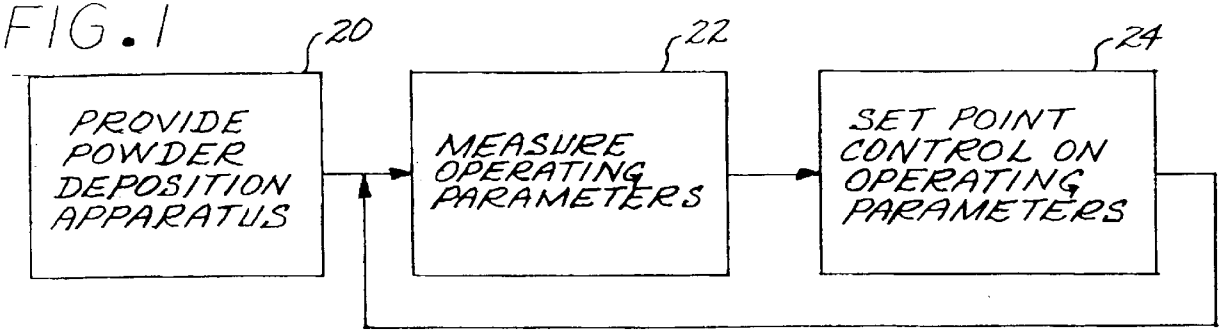
FIG. 1 is a block flow diagram of a preferred approach for practicing the invention.
Figure 3:
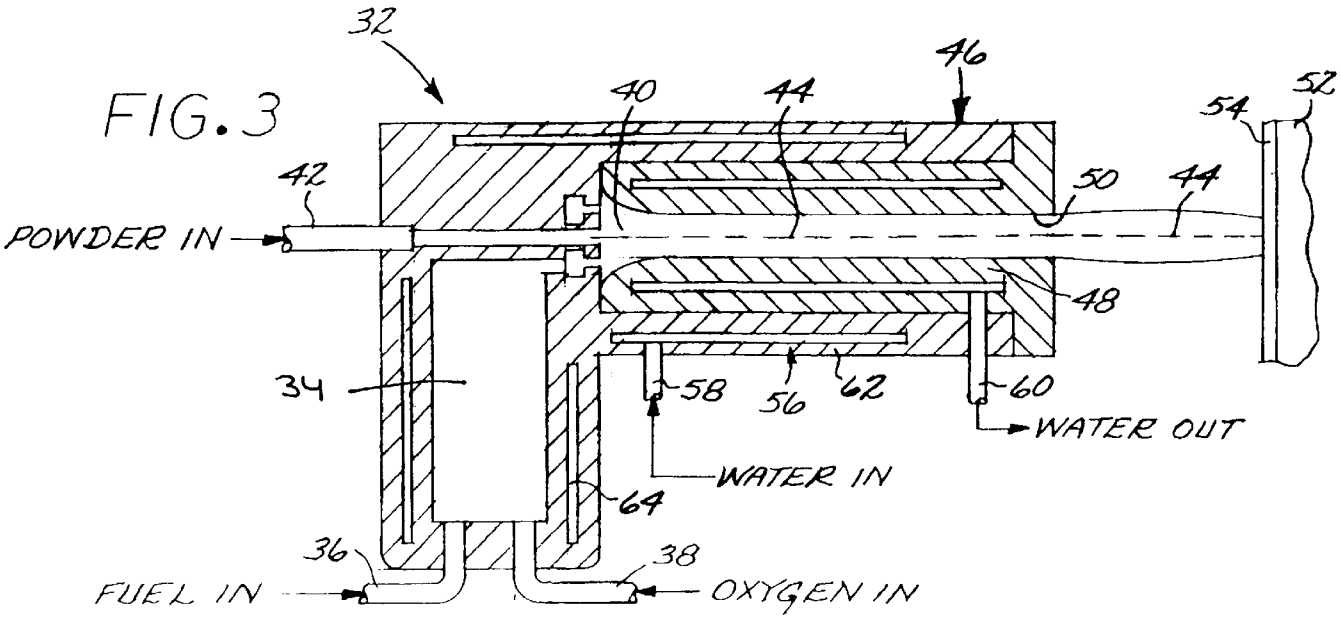
FIG. 3 is a sectional view of a deposition gun.
Figure 2:
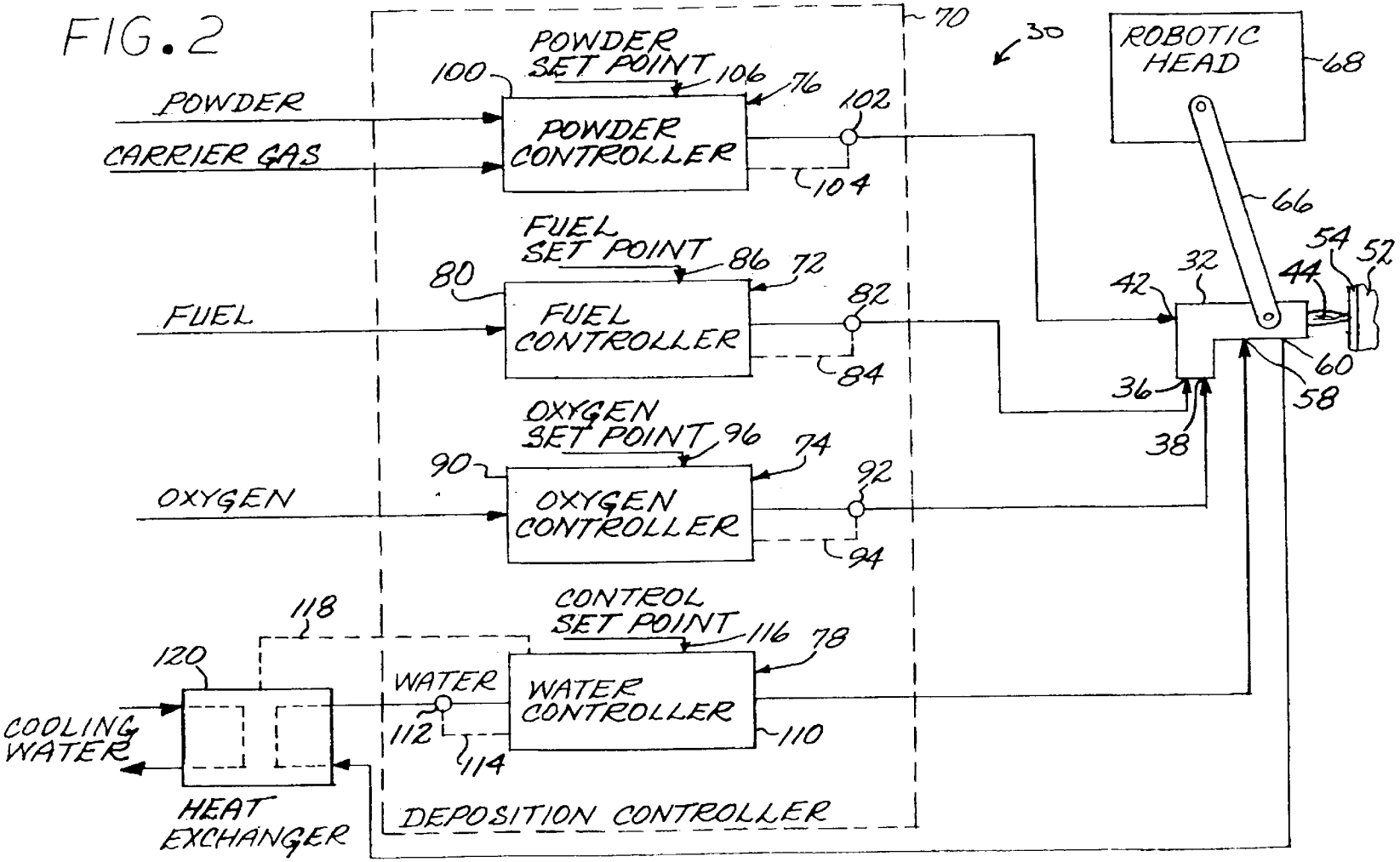
FIG. 2 is a system schematic diagram of the deposition apparatus.

FIG. 1 depicts an approach for forming a deposit on a substrate, and FIG. 2 illustrates an operable powder deposition apparatus 30 for accomplishing this deposition. The powder deposition apparatus 30 is provided, step 20. The preferred form of the powder deposition apparatus 30 includes a deposition gun 32 shown in FIG. 3 and comprising a combustion chamber 34 wherein a mixture of a fuel supplied through a fuel inlet 36 and an oxidizer supplied through an oxidizer inlet 38 is burned to generate a pressurized deposition gas flow. In a mixer 40 the pressurized deposition gas flow is mixed with a powder flow 42 to form a deposition mixture flow 44. Preferably, the mixer comprises a central powder flow injector, and a set of deposition gas injectors arranged around a periphery of the central powder flow injector. A deposition flow director 46, herein including a barrel 48 and a powder spray nozzle 50 oppositely disposed along the barrel 48 from the mixer 40, receives the deposition mixture flow 44 from the mixer 40. The powder spray nozzle 50 increases the pressure within the deposition mixture flow 44, so that it is projected toward a deposition substrate 52 at high velocity to form a deposit 54 thereon. The deposition gun 32 further includes a cooling structure 56 operable with a flowing coolant passing therethrough and in cooling communication with the mixer 40, the deposition flow director 46, and the combustion chamber 34. The preferred flowing coolant is a water flow, supplied through a water inlet 58 and removed through a water outlet 60. The cooling structure 56 may be of any operable form, but is preferably a water jacket 62 surrounding the cooled regions and having an interior water flow volume 64.

In the present approach, the deposition gun 32 is utilized in conjunction with a deposition controller 70 shown in FIG. 2. The deposition controller 70 includes a controllable fuel source 72 of the fuel communicating with the fuel inlet 36 of the combustion chamber 34, a controllable oxidizer source 74 of the oxidizer, preferably oxygen gas, communicating with the oxidizer inlet 38 of the combustion chamber 34, a controllable powder source 76 of the powder flow communicating with the powder flow 42 to the mixer 40, and a controllable coolant source 78 of a flow of the coolant that provides the inlet flow 58 of the coolant to the cooling structure 56.

The controllable fuel source 72 includes a fuel controller 80 that receives an input flow of fuel, preferably hydrogen gas, and outputs a controlled flow of fuel to the fuel inlet 36. A fuel flow sensor 82 senses the flow of fuel to the fuel inlet 36 and provides that information as a fuel feedback signal 84 to the fuel controller 80. The fuel controller 80 automatically maintains the fuel flow to the fuel inlet 36 at a fixed value of a fuel set point 86 by maintaining the difference between the fuel set point 86 and the fuel feedback signal 84 small, and preferably zero.

The controllable oxidizer source 74 includes an oxygen controller 90 that receives an input flow of oxygen (the preferred oxidizer), and outputs a controlled flow to the oxidizer inlet 38. An oxygen flow sensor 92 senses the flow of oxygen to the oxidizer inlet 38 and provides that information as an oxygen feedback signal 94 to the oxygen controller 90. The oxygen controller 90 automatically maintains the oxygen flow to the oxidizer inlet 38 at a fixed value of an oxygen set point 96 by maintaining the difference between the oxygen set point 96 and the oxygen feedback signal 94 small, and preferably zero.

The controllable powder source 76 includes a powder controller 100 that receives an input flow of powder mixed with a carrier gas such as argon or nitrogen, and outputs the powder flow 42. A powder flow sensor 102 senses the powder mass of the powder flow 42 and provides that information as a powder feedback signal 104 to the powder controller 100. The powder controller 100 automatically maintains the powder flow 42 at a fixed value of an powder set point 106 by maintaining the difference between the powder set point 106 and the powder feedback signal 104 small, and preferably zero.

The controllable water source 78 includes a water controller 110 that receives an input flow of water, and outputs a water flow to the water inlet 58. A water sensor 112 senses a cooling capacity of the water flow that reaches the water inlet 58 and provides that information as a water feedback signal 114 to the water controller 110. The water controller 110 automatically maintains the water flow to the water inlet 58 a fixed value of cooling capacity established by a water control set point 116 by maintaining the difference between the water control set point 116 and the water feedback signal 114 small, and preferably zero.

The cooling capacity of the water flow as measured by the water sensor 112 may be the temperature of the water or the flow rate of the water to the water inlet 58, or a combination of these two values. To control the temperature of the water in a closed loop cooling system, the water controller 110 provides a water control signal 118 to a controllable heat exchanger, wherein heat is removed from the water flow leaving the deposition gun 32 through the water outlet 60. To remove more heat from the water flow from the water outlet 60, and thence lower its temperature, the flow of cooling water to the heat exchanger 120 is increased. To control the flow rate of the water, the water controller 110 includes a flow control valve.

This feedback control system of the deposition controller 70 was found necessary because the performance of the deposition gun 32 is highly sensitive to slight variations in these operating parameters. Without the feedback control system, normal operating variations from the set points would result in a substantial change in the performance of the deposition gun 32 and in some cases the quality of the deposit 54.

One of the important advantages of the present approach as compared with the detonation-gun approach is that the deposition gun 32 of the present invention weighs only about 5–10 pounds, including the weight of the hoses that are supported with the deposition gun. The deposition gun 32 may therefore be mounted on an arm 66 extending from a robotic head 68 and moved around the workpiece that constitutes the substrate 52. By comparison, the detonation gun is so massive that it must remain stationary, and the workpiece must be moved.

In a prototype powder deposition apparatus 30, the preferred fuel was hydrogen gas, the preferred oxidizer was oxygen gas, the preferred ratio of hydrogen to oxygen was from about 2.2 to about 2.6, most preferably about 2.4, and the preferred powder flow rate of Metco 73FNS WC/Co powder mixed with argon carrier gas at 35–70 standard cubic feet per minute was 18–25 grams per minute. The water was flowed to the water inlet 58 at a constant rate, and its temperature was controlled to the set point value, preferably 68° F., by controlling the heat exchanger 120 as described above.

The present approach has been reduced to practice using the prototype apparatus and comparatively tested against the two major competitive deposition approaches. Multiple specimens of tungsten carbide/cobalt deposited on a titanium alloy substrate were prepared by the present approach, by an approach wherein the same deposition gun as used in the present approach was employed, but without the deposition controller 70, and by the D-gun approach. The specimens were tested by subjecting each specimen to a wear test previously determined to be meaningful in the pertinent applications. In the wear test, two identical specimens were impacted and slid over each other, and then the loss of material thickness was measured after two million cycles. The present approach using the deposition gun 32 and the deposition controller 70 resulted in a mean measured material loss of 0.20 mils (thousandths of an inch). The approach using the deposition gun 32 only and without the deposition controller 70 resulted in a mean measured material loss of 0.83 mils. The D-gun approach resulted in a mean measured material loss of 3.05 mils.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

What is claimed is:

1. A powder deposition apparatus operable to form a deposit on a deposition substrate, the powder deposition apparatus comprising:

a deposition gun comprising a combustion chamber wherein a mixture of a fuel and an oxidizer is burned to generate a pressurized deposition gas flow, a mixer wherein the pressurized deposition gas flow is mixed with a powder flow to form a deposition mixture flow, a deposition flow director that receives the deposition mixture flow from the mixer and directs the deposition mixture flow toward the deposition substrate, and a cooling structure operable with a flowing coolant passing therethrough and in cooling communication with the mixer and with the deposition flow director;

an instrumentation array providing a fuel measurement of a flow rate of the fuel to the combustion chamber, an oxidizer measurement of a flow rate of the oxidizer to the combustion chamber, a powder measurement of a flow rate of a powder feed to the mixer, and a coolant measurement of a cooling capacity of the coolant; and a deposition controller including a controllable fuel source of the fuel communicating with the combustion chamber, wherein the controllable fuel source is automatically controlled responsive to the fuel measurement, a controllable oxidizer source of the oxidizer communicating with the combustion chamber, wherein the controllable oxidizer source is automatically controlled responsive to the oxidizer measurement, a controllable powder source of the powder flow communicating with the mixer, wherein the controllable powder source is automatically controlled responsive to the powder measurement, and a controllable coolant source of a flow of the coolant that provides an inlet flow of coolant to the cooling structure, wherein the controllable coolant source is automatically controlled responsive to the coolant measurement.

2. The powder deposition apparatus of claim 1, wherein the mixer comprises a central powder flow injector, and a set of deposition gas injectors arranged around a periphery of the central powder flow injector.

3. The powder deposition apparatus of claim 1, wherein the deposition flow director includes a barrel that receives the deposition mixture flow from the mixer, wherein the mixer is positioned at a first end of the barrel, and a powder spray nozzle positioned at a second end of the barrel opposite from the first end, wherein the powder spray nozzle is operable to project the deposition flow mixture toward the substrate.

4. The powder deposition apparatus of claim 1, wherein the cooling structure comprises a cooling jacket extending around at least a portion of the mixer and the deposition flow director.

5. The powder deposition apparatus of claim 1, wherein the controllable fuel source comprises a source of hydrogen gas, and the controllable oxidizer source comprises a source of oxygen gas.

6. The powder deposition apparatus of claim 5, wherein a flow ratio of the hydrogen gas to the oxygen gas is from about 2.2 to about 2.6.

7. The powder deposition apparatus of claim 1, wherein the controllable powder source comprises a source of a mixture of the powder entrained in a carrier gas.

8. The powder deposition apparatus of claim 1, wherein the coolant measurement comprises a measured temperature of the flowing coolant, and wherein the controllable coolant source comprises a heat exchanger that receives an outlet flow of the coolant, controllably cools the outlet flow of the coolant responsive to the measured temperature, and provides a cooled coolant flow to the cooling structure.

9. The powder deposition apparatus of claim 1, wherein the coolant measurement comprises a measured outlet temperature of an outlet flow of the coolant from the cooling structure, and wherein the controllable coolant source comprises a heat exchanger that receives an outlet flow of the coolant, controllably cools the outlet flow of the coolant responsive to the measured outlet temperature, and provides a cooled coolant flow to the cooling structure.

10. The powder deposition apparatus of claim 1, wherein the coolant measurement comprises a measured flow rate of the coolant, and wherein the controllable coolant source comprises a flow controller that provides the flow of the coolant responsive to the measured flow rate of the coolant.

11. The powder deposition apparatus of claim 1, further including a robotic head that supports and moves the deposition gun.

12. A powder deposition apparatus operable to form a deposit on a deposition substrate, the powder deposition apparatus comprising:

a deposition gun;

an instrumentation array providing a fuel measurement of a flow rate of a fuel to the deposition gun, an oxidizer measurement of a flow rate of an oxidizer to the deposition gun, a powder measurement of a flow rate of a powder feed to the deposition gun, and a coolant measurement of a cooling capacity of a coolant provided to the deposition gun; and a deposition controller including a controllable fuel source of the fuel communicating with the deposition gun, a controllable oxidizer source of the oxidizer communicating with the deposition gun, a controllable powder source of the powder flow communicating with the deposition gun, and a controllable coolant source of a flow of the coolant that provides an inlet flow of coolant to the deposition gun, wherein the controllable fuel source is automatically controlled responsive to the fuel measurement, the controllable oxidizer source is automatically controlled responsive to the oxidizer measurement, the controllable powder source is automatically controlled responsive to the powder measurement, or the controllable coolant source is automatically controlled responsive to the coolant measurement.

13. The powder deposition apparatus of claim 12, wherein the deposition gun comprises a combustion chamber wherein a mixture of the fuel and the oxidizer is burned to generate a pressurized deposition gas flow, a mixer wherein the pressurized deposition gas flow is mixed with the powder flow to form a deposition mixture flow, a deposition flow director that receives the deposition mixture flow from the mixer and directs the deposition mixture flow toward the deposition substrate, and a cooling structure operable with a coolant and in cooling communication with the mixer and with the deposition flow director.

14. The powder deposition apparatus of claim 12, wherein the controllable fuel source is automatically controlled responsive to the fuel measurement, the controllable oxidizer source is automatically controlled responsive to the oxidizer measurement, the controllable powder source is automatically controlled responsive to the powder measurement, and the controllable coolant source is automatically controlled responsive to the coolant measurement.

* * * * *

UNITED STATES PATENT AND TRADEMARK OFFICE

CERTIFICATE OF CORRECTION

PATENT NO. : 6,736,902 B2 
DATED : May 18, 2004
INVENTOR(S) : Stephen Wayne Tefft, Paul C. Madix, James R. Reinhardt and Tag A. Koenig It is certified that error appears in the above-identified patent and that said Letters Patent is hereby corrected as shown below:

Title page,
Item [74], *Attorney, Agent, or Firm*, "Wallae" should be -- Wallace --.
Item [57], ABSTRACT,
Line 2, "bums" should be -- burns --.

Signed and Sealed this

Sixteenth Day of November, 2004

JON W. DUDAS
*Director of the United States Patent and Trademark Office*